United States Patent [19]

Schuman

[11] 4,448,312

[45] May 15, 1984

[54] VERTICAL FOOD HOLDER

[76] Inventor: Eldor N. Schuman, 9633 10th Ave., Carney, Md. 21234

[21] Appl. No.: 359,507

[22] Filed: Mar. 18, 1982

[51] Int. Cl.[3] ..... A47F 7/00

[52] U.S. Cl. ..... 211/49 R; 211/126; 211/13; 211/71; 220/23.4

[58] Field of Search ..... 52/584, 586; 108/51.3, 108/902; 206/504; 211/49 D, 49 R, 50, 59.1, 126, 13, 71; 220/23.2, 23.4, 23.83; 404/40, 41, 50, 51, 52

[56] References Cited

U.S. PATENT DOCUMENTS

| | | | |
|---|---|---|---|
| 1,504,421 | 8/1924 | Bishop | 211/49 R |
| 3,124,858 | 3/1964 | Blonde | 52/586 X |
| 3,877,603 | 4/1975 | Holz | 220/23.83 |
| 4,043,477 | 8/1977 | Deese | 206/504 X |

FOREIGN PATENT DOCUMENTS

| | | | |
|---|---|---|---|
| 2336934 | 2/1975 | Fed. Rep. of Germany | 220/23.4 |

*Primary Examiner*—Ramon S. Britts
*Assistant Examiner*—Blair M. Johnson
*Attorney, Agent, or Firm*—Walter G. Finch

[57] ABSTRACT

This invention is an improved holder for food, and in particular for dispensing slices of bread from a loaf. The holder positions the loaf of bread vertically, on one end, so that slices may be dispensed from the top, the user taking the slices from the exposed top end as the loaf is positioned vertically on end. The slices of the loaf may be completely unwrapped or may be left in the wrapper with the top end opened. A plurality of the holders may be assembled and affixed to each other, thus permitting a plurality of different breads or several loaves of like bread to be positioned for dispensing at the same time. An additional unit to hold condiments may also be affixed to a vertical bread holder unit or a plurality of the holders. Each unit has a base and a plurality of vertical retainers to hold the loaf of bread vertical. A connector piece connects and affixes holder units to each other when several units are used concurrently.

5 Claims, 8 Drawing Figures

VERTICAL FOOD HOLDER

BACKGROUND AND SUMMARY OF THE INVENTION

The invention relates to baked goods and in particular to bread. Specifically, the invention relates to holders for loaves of bread for the purpose of dispensing slices therefrom.

Numerous holders have been invented for holding loaves of bread or for dispensing slices from loaves of bread. Most of the bread holders of the prior art either position the bread horizontally, thus taking up considerable space, or set at an incline, also taking up more space than necessary.

Horizontal dispensers usually are equipped with mechanical means for moving the bread forward to the point where it is dispensed, thus resulting in a complicated and costly device.

Inclined dispensers are likewise costly and complicated, in that the slices are dispensed from the bottom. The bottom dispenser method usually is so arranged so as to mechanically eject, or start to eject, the slice of bread, again requiring a complicated and costly mechanism.

The present invention provides a very simple and uncomplicated structure with no moving parts. The loaf of bread is held vertically, thus taking up a very minimum of space.

In the present invention the bread is dispensed from the top, the method being very simple and easy to use. The user merely lifts off the top slice, or more than one slice if desired. No operation of any levers, catches, or doorways is necessary.

The present invention also provides a very simple and easy to assemble means so that a plurality of holders can be affixed to each other, thus maintaining the space saving efficiency when more than one loaf of bread is to be provided for a large group of users. The plurality of holders thus assembled also provides for the easy display of several kinds of bread in loaves, such as white, rye, whole wheat, and other breads.

In addition the invention also provides for an attachment to hold an assortment of condiments, such as salt, pepper, sugar, mustard, catsup, and other such condiments. Thus, daily use condiments could be included if the invention is used in the home, or a variety of condiments could be displayed if the dispenser units are used in places such as a cafeteria.

In the present invention the loaf of bread may be placed in the holder unwrapped, such as when the use will be very rapid. It may also be placed in the holder in the wrapper with top opened, such as when the use is infrequent, as in the home or during slack periods in a cafeteria, so that the bread is kept fresh and in order to prevent drying out.

While breads have been mentioned hereinbefore, it is to be noted and understood that the units may also be used for dispensing other baked products, such as hamburger buns, rolls, similarly shaped pastries, and other items. Such varied uses are within the scope and intent of this invention.

The use of the vertical bread holder holds the loaf of bread in a fixed position so as to make it easy to obtain one or more slices. This is particularly helpful where table or counter or serving space is limited, and also where the user might also be holding or carrying other food, such as in a cafeteria line. In this latter situation, a condiment holder can be used at each end to provide easy access to a variety of condiments as the user passes along the line.

It is therefore, an object of this invention to provide a device to hold a loaf of bread in a vertical position.

It is another object of the invention to provide a device that holds a loaf of bread vertically for purposes of dispensing slices from the top.

It is also an object of the invention to provide a device that will hold a loaf of bread vertically for dispensing slices from the top that may be a wrapped or unwrapped loaf.

It is yet another object of the invention to provide a device for holding a loaf of bread vertically that can be removably coupled in a series in a simple manner to provide a plurality of loaves of bread held vertically.

It is still another object of the invention to provide a condiment holding unit that can be removably affixed to the vertical bread holding units.

It is yet still another object of the invention to provide a device for holding a loaf of bread and other foods that is simple in structure with no moving parts.

Further objects and advantages of the invention will become more apparent in light of the following description of the preferred embodiments.

DESCRIPTION OF THE PREFERRED EMBODIMENTS

Figure 1:
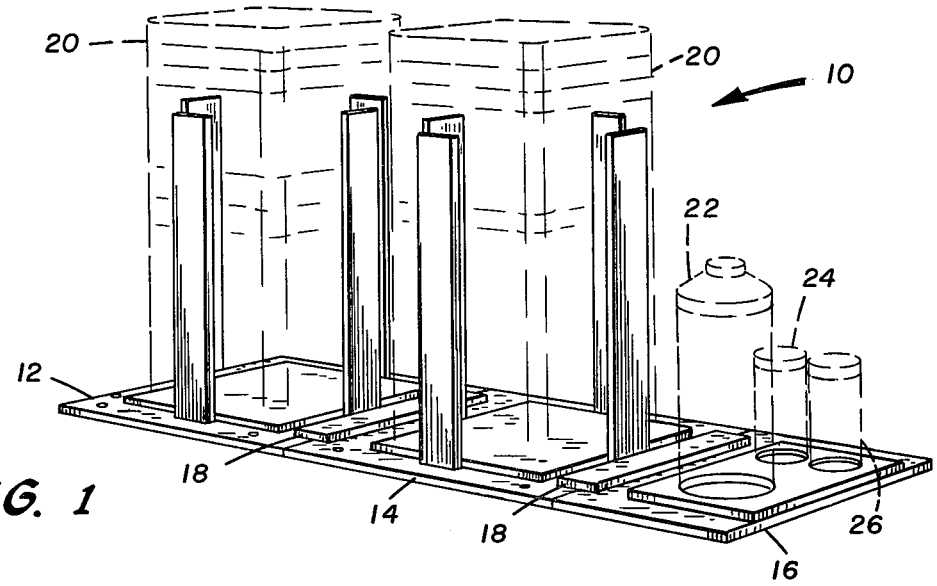
FIG. 1 is a pictorial view of an assembled food holder.

Referring now to the drawings and particulary to FIG. 1, an improved food holder is shown at 10. In FIG. 1 the food holder 10 is shown holding a plurality of loaves of bread 20 in food holder units 12 and 14, and other foods, such as condiments, in food holder unit 16.

Note that all the foods are positioned vertically, the loaves of bread 20 are held in a vertical position in food holder units 12 and 14, and the condiment foods are in containers 22, 24, and 26 which are also held vertically.

The condiments in containers 22, 24, and 26 may be such as sugar in a dispenser container 22, salt in a dispenser shaker 24, and pepper in a dispenser shaker 26. However, it is to be understood that it is within the scope and intent of this invention that instead of the loaves of bread 20, that foods such as hamburger buns, pastries, and the like could be held and dispensed from the food holder units 12 and 14; and that condiments such as mustard, catsup and other such condiment foods could be held and dispensed from containers similar to condiment food containers 22, 24 and 26 held vertically in food holder unit 16.

As shown in FIG. 1, two food holder units 12 and 14, and one food holder unit 16 are shown removably affixed to each other with a universal connector means 18, thus operating as a system. It is to be understood that it is within the scope and intent of this invention, that any plurality of food holder units 14 and 16, which are alike, may be assembled together in a similar manner with universal connector means 18; further, that food holder unit 16 may be assembled in a similar manner at each end of such a plurality array.

As will be described hereinafter, it can be seen that a plurality food holder units 14 and 16 may be removably assembled in line as shown in FIG. 1, or they may be removably assembled in other geometric patterns, such as a square, or as an "L", and other similar arrangements. A food holding unit 16 may be removably assembled at an end as shown in FIG. 1 or at other points as described hereinafter.

Figure 2:
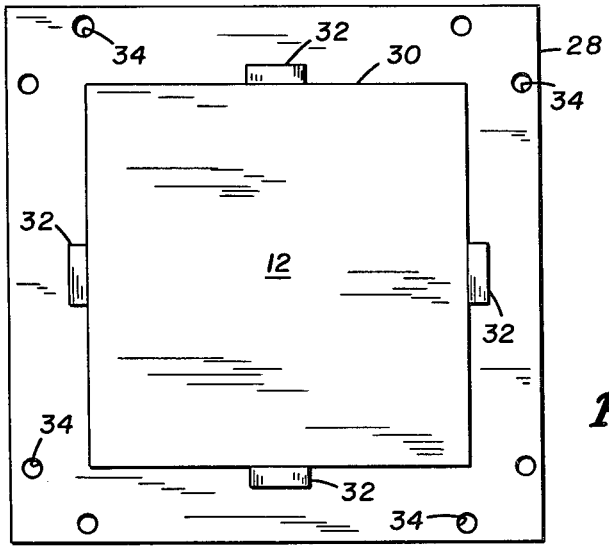
FIG. 2 is a top view of a single unit of a food holder.
Figure 3:
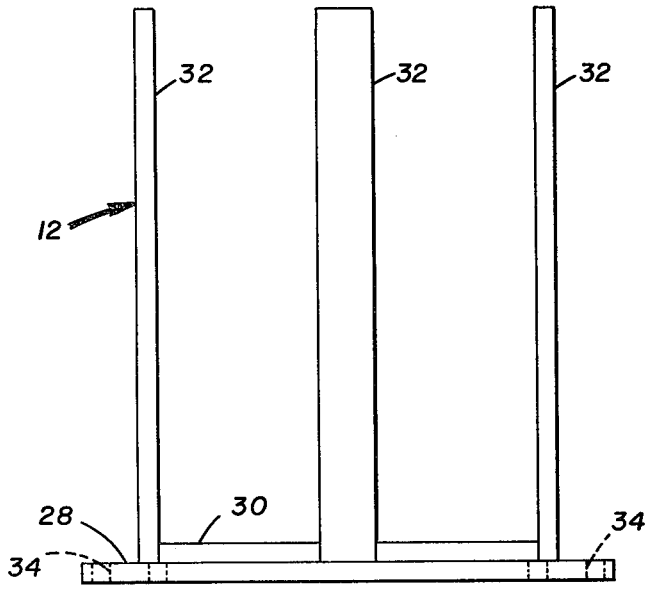
FIG. 3 is a side view of FIG. 2.

Continuing with the description of the structure of this invention, food holder units 12 and 14 are exactly alike and food holder unit 12 is shown in FIGS. 2 and 3 in detail as being typical of both food units.

The structure of food units 12 and 14 are shown in FIGS. 2 and 3. The structure consists of a base means 28, a food support means 30, and a plurality of retainer means 32.

Base means 28 and food support means 30 may be an assembly of two separate pieces or they may be combined as a single integral and monolithic unit. The food support means 30 is centrally located on the base means 28. It is to be noted and understood that the omission of the food support means 30 on top of the base means 28 is within the scope and intent of this invention. The use of the food support means 30 increases the strength and stability of the overall food holder unit 12 or 14.

The plurality of retainer means 32 are spaced around the food support means and rigidly affixed to the base means 28 by means known in the art of construction. It is also to be noted and understood that removably affixed retainer means 32 are within the scope and intent of this invention. Four retainer means 32 are shown in FIGS. 1, 2 and 3 for food holder units 12 or 14, but is to be understood that the number in the plurality may be varied as long as it retains the food being placed therein and provided that easy access to the food is available, as is the case illustrated for loaves of bread 20 in FIG. 1.

Figure 4:
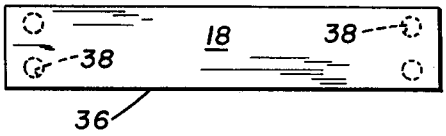
FIG. 4 is a top view of a connector means for affixing a series of food holders to each other.
Figure 5:
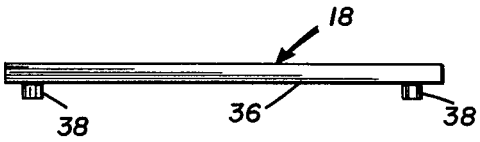
FIG. 5 is a side view of FIG. 4.
Figure 6:
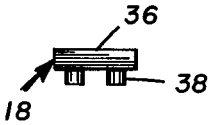
FIG. 6 is an end view of FIG. 4.

The base means 28 has a plurality of holes or sockets 34 to receive the coupling or connector means projections 38 shown in FIGS. 4, 5 and 6. Note that the holes or sockets 34 are in pairs on each side of the base means 28. This permits removably assembling a food holder unit 12 to a food holder unit 14 on any of the sides, thus, the food holder units may be assembled in line, as an "L" shaped arrangement, as a square, or in other geometrical arrangements.

When assembled, the retainer means 32 hold or retain the food such as a loaf of bread 20 as illustrated, within the confines of the retainer means 32, but leaves ample space to reach in and pick-up a piece of food, such as a slice of bread from a loaf 20.

The connector or coupling means 18 consist of a body member 36 and a plurality of projections 38 on one surface thereof. The projections are in matched pairs, so spaced that they mate with and may be removably assembled in a pair of holes or sockets 34 when a food holding unit 12 is placed adjacent to a food holding unit 14 for removable assembly thereto. When so assembled, a matching pair of projections 38 removably fit into a pair of holes or sockets 34 in a food holding unit 12 and similarly, a matching pair of projections 38 removably fit into a pair of holes or sockets 34 in food holding unit 14. Thus, removably assembling food holding unit 12 to food holding unit 14, as shown in FIG. 1.

Figure 7:
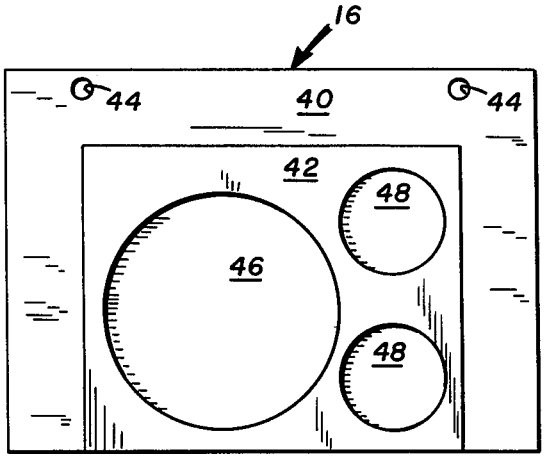
FIG. 7 is a top view of a condiment holder for association with, and affixing to, a food holder.

The projections 38 and the holes or sockets 34 and 44 are shown in FIGS. 4, 2, and 7 respectively, as being round or circular in plan view, however, it is to be understood that they may be square, triangular, or any other geometric shape, providing that they mate and assemble with each other. Also, that the number in the plurality of each may vary from the number as illustrated in the drawings. Such variations are within the scope and intent of this invention.

Figure 8:
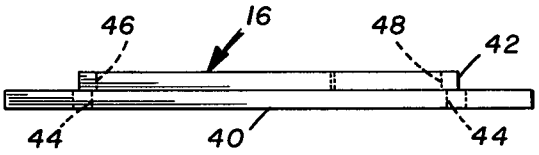
FIG. 8 is a side view of FIG. 7.

The other food holding unit 16, mentioned hereinbefore and shown in FIG. 1, is shown in detail in FIGS. 7 and 8. This food holding unit 16 is for holding condiment foods for use with foods in food holding units 12 and 16, each of which may contain different foods, or different varieties of food.

As shown in FIGS. 7 and 8, food holding unit 16 is suitable for holding condiment food containers for foods such as sugar, salt, pepper, mustard, catsup and other similar condiment foods. As the containers are usually round or circular the depressions or depressed areas for holding them are shown round or circular, such as depression or depressed area 46 for a sugar container and depressions or depressed areas 48 for salt and pepper containers. However, condiment containers of other geometric configuration may also be set into the round or circular depressions 46 and 48 respectively, or other geometrically shaped depressions may be used. Such variations are also within the scope and intent of this invention.

The food holding unit 16 consists of a base means 40 and condiment container support means 42. As described for base means 28 and food support means 30, base means 40 and condiment container support means 42 may also be separate members, or they may be integrally and monolithically formed, or the depressions 46 and 48 may be formed in the base portion only. As shown in FIGS. 7 and 8, the configuration provides more stability and strength.

In a manner similar to base means 28, the base means 40 has a plurality of holes or sockets 44, corresponding to holes or sockets 34, to removably receive projections 38 of connector or coupling member 18 for removable assembly to food holding unit 12 or 14.

As shown in FIG. 7, the holes or sockets 44 are shown on one side only of base means 40, but it is to be noted and understood that the forming of holes or sockets 44 on other sides of base means 40 in a configuration and in a manner similar to that shown for holes or sockets 34 on base means 28, is within the scope and intent of this invention.

The food holding units 12, 14 and 16, and the coupling member 18 may be made of wood, plastics, metal or any other suitable material.

As can be readily understood from the foregoing description of the invention, the present structure can be configured in different modes to provide the ability to hold food, including condiment foods in containers.

Accordingly, modifications and variations to which the invention is susceptible may be practiced without departing from the scope and intent of the appended claims.

What is claimed is:

1. A food holding system, comprising:

at least one of a first food holding unit, said first food holding unit having a first base means, a first food support means, and a plurality of first retainer means, said first base means being substantially square in configuration and having a thickness and a top face side and a bottom face side, said bottom face side being for the purpose of providing an interface with any surface upon which said first food holding unit is placed, said first food support means being substantially square in configuration, but of lesser outside dimensions in each direction than said substantially square first base means, said first food holding unit having a thickness and a top face side and a bottom face side, said first food support means being centrally located on and suitably affixed to said first base means, said bottom face side of said first food holding unit interfacing with said top face side of said first base means, the four edges of said substantially square first food holding unit being substantially parallel with the respective four edges of said substantially square first base means on which it is centrally located and to which it is suitably affixed, said plurality of first retainer means being peripherally located and spaced around said first food support means and suitably affixed to said top face side of said first base means and individually to one of said four edges of said substantially square first food holding unit, each of said first retainer means of said plurality of first retainer means being further centrally positioned along the peripheral outside edge of one of said four edges of said substantially square first food holding unit, each of said first retainer means being substantially rectangular in cross sectional configuration, said plurality of first retainer means extending vertically upward from said first base means, said plurality of first retainer means having no interface with each other, said plurality of spaced first retainer means retaining food in position therebetween and positioned on said first food support means, said first base means having a plurality of apertures therein, said plurality of apertures being arranged in a symetrical pattern on said top face side, said plurality of apertures in said symetrical pattern being spaced apart, equal portions of said plurality of apertures with each portion in like symetrical patterns being each centrally positioned along and spaced from one of said four edges of said substantially square first base means;

at least one of a second food holding unit, said second food holding unit having a second base means, and a plurality of second retainer means, said second base means being substantially rectangular in configuration and having a thickness and a top face side and a bottom face side, said bottom face side being for the purpose of providing an interface with any surface upon which said second food holding unit is placed, said plurality of second retainer means being of a depressed area configuration for each retainer means of said plurality of second retainer means, said plurality of second retainer means being formed as a plurality of said depressed area configurations set into a substantially rectangular member, said substantially rectangular member with said plurality of depressed areas therein having a longer side thereof being centrally positioned along a dimensionally longer edge of said second base means, said longer side of said substantially rectangular member coinciding with said dimentionally longer edge of said second base means, the dimensionally shorter side of said substantially rectangular member being dimensionally less than the dimensionally shorter edge of said substantially rectangular second base means, said plurality of depressed areas being circular in configuration, said substantially rectangular member being suitably affixed to said top face side of said second base means as located and positioned, said second retainer means having said plurality of depressed areas therein holding food in a plurality of containers, said plurality of containers of food being retained within and by said plurality of depressed area and held in a vertical position thereby, said second base means having a plurality of apertures therein, said plurality of apertures being arranged in a symetrical pattern and spaced apart similar to one of said portions of said plurality of apertures in said first base means, said plurality of apertures in said second base means being centrally positioned along and spaced from the dimensionally longer edge of said second base means opposite to said longer side coinciding with said longer side of said substantially rectangular member, said symetrical pattern and spacing of apertures in said second base means from said longer edge matching similar said symetrical pattern and spacing of said apertures in said first base means, said pattern of apertures in first and second base means respectively, being directly opposite to each other at the adjacent edges of said first and second base means, respectively; and at least one of a coupling means, said coupling means being removably assembled to said first and second food holding units, respectively, said coupling means thereby affixing said first food holding unit to said second food holding unit in a lateral relation to each other, said coupling means having a body member and a plurality of projection means, said body member having a top surface and a bottom surface, said plurality of projection means being suitably affixed to said bottom surface of said body member, said plurality of projection means being spaced in a symmetrical pattern on said bottom surface of said body member, said symmetrical pattern matching said symmetrical pattern of apertures in adjacent first and second base means when assembled adjacent to each other, said symmetrical patterns of said apertures and said projection means providing for assembly of said first food holding unit to said second food holding unit by removably inserting said symmetrical pattern of projection means into said symmetrical pattern of apertures in said adjacent first and second base means to removably affix said first food holding unit to said second food hold unit.

2. A food holding system as recited in claim 1 and additionally, a plurality of additional first food holding units, and a plurality of additional coupling means, each additional first food holding unit of said plurality of first food holding units individually and successively being removably assembled and affixed to each other and the resulting assembly thereof being removably assembled and affixed to said at least one of a first food holding unit by the use of said plurality of additional coupling means.

3. A food holding system as recited in claim 2 and additionally, at least one additional second food holding unit, and at least one additional coupling means, said at least one additional second food holding unit being removably assembled and affixed to one of said additional first food holding units by the use of said at least one additional coupling means.

4. A food holding system as recited in claim 1, wherein said first food holding unit is for holding and positioning loaves of bread in a vertical position standing on one end.

5. A food holding system as recited in claim 1, wherein said second food holding unit is for holding condiment type foods in containers, said containers being held in a vertical upright position.

* * * * *